United States Patent [19]

Leiser et al.

[11] 4,025,357

[45] May 24, 1977

[54] ION EXCHANGE ENRICHMENT OF IMPURE DEXTROSE SOLUTIONS

[75] Inventors: Roger S. Leiser; Gin Chain Liaw; Charles E. Schollmeier, all of Decatur, Ill.

[73] Assignee: A. E. Staley Manufacturing Company, Decatur, Ill.

[22] Filed: Apr. 14, 1975

[21] Appl. No.: 568,067

[52] U.S. Cl. ..... 127/46 A; 127/46 R; 127/55; 127/58

[51] Int. Cl.[2] ..... C13K 1/00; C13K 1/08; C13K 3/00

[58] Field of Search ..... 127/30, 46 R, 46 A, 127/46 B, 58, 55

[56] References Cited

UNITED STATES PATENTS

| | | | |
|---|---|---|---|
| 2,606,847 | 8/1952 | Newkirk | 127/30 X |
| 2,610,931 | 9/1952 | Montgomery | 127/55 |
| 2,818,851 | 1/1958 | Khym | 127/46 R |
| 2,871,147 | 1/1959 | Smith | 127/46 A X |
| 3,044,906 | 7/1962 | Lefevre | 127/46 R |
| 3,305,395 | 2/1967 | Scallet | 127/46 B X |
| 3,785,864 | 1/1974 | Lauer | 127/46 A |
| 3,817,787 | 6/1974 | Hertzen | 127/46 B |
| 3,864,166 | 2/1975 | Barker | 127/46 R |

*Primary Examiner*—Sidney Marantz
*Attorney, Agent, or Firm*—M. Paul Hendrickson; Charles J. Meyerson

[57] ABSTRACT

Mother liquors obtained from a dextrose crystallization process may be upgraded for re-cycling to dextrose crystallizers by transferring the mother liquor through a bed of an adsorption agent which preferentially adsorbs either dextrose or oligosaccharides. A dextrose-rich portion of the mother liquor is then recovered from either the dextrose-rich fraction which passes through the bed or has been preferentially adsorbed and eluted from the bed with a solvent.

12 Claims, No Drawings

ION EXCHANGE ENRICHMENT OF IMPURE DEXTROSE SOLUTIONS

The present invention relates generally to a method for producing dextrose in increased yield from starch. More particularly, the present invention is directed to the treatment of mother liquor obtained from dextrose crystallization processes so as to recover additional dextrose therefrom.

Dextrose is manufactured from corn starch, potato starch or other starches by hydrolysis. The hydrolysis may be effected by mineral acids, by mineral acids in combination with enzymes, or by enzyme treatment. An aqueous suspension containing starch is hydrolyzed to provide a starch converted dextrose solution. It is known to remove impurities of a non-carbohydrate nature from the starch converted dextrose solution by coagulation and filtration and by treatment with ion exchange resins. It is also known to decolorize the starch converted dextrose solution by passing the solution through filters of bone-black or activated carbon.

The starch converted dextrose solution is then evaporated under reduced pressure to provide a syrup containing about 75 percent solids. The syrup is cooled to a temperature of about 43° C and is fed to crystallizers. A substantial bed of seed crystals containing about 25 percent of a previous batch is left in the crystallizer and the fresh syrup is mixed with the seed crystals. The mass is slowly cooled to a crystallization temperature for a period of time sufficient to crystallize about 60 percent of dextrose in the monohydrate form therefrom.

As a result, there is left over a mother liquor containing dextrose and a certain amount of oligosaccharides. The mother liquor, rather than being concentrated directly for recovery of a second crop of crystals, may be subjected to reconversion by acid or enzyme treatment. Oligosaccharides are present in the mother liquor, due principally to condensation of a part of the dextrose in the later stages of hydrolysis of the starch. These oligosaccharides may be hydrolyzed to yield further quantities of dextrose during the reconversion of the mother liquor. After reconversion and concentration, the mother liquor is fed to crystallizers.

Crystallization of dextrose and recovery of a second crop of dextrose crystals from the mother liquor usually requires a considerably longer period of time than the first crop. The second dextrose crop is generally not considered equivalent to the quality of the dextrose obtained during the first crystallization. This is due principally to the presence of unconverted oligosaccharides. The greatly increased time for effecting crystallization of the dextrose from the revonverted mother liquor is also attributed, at least in part, to the presence of oligosaccharides.

Even when the mother liquor is reconverted, the highest yield of crystalline dextrose usually obtained from a given amount of starch converted dextrose solution in commercial operations is about 82 percent. The balance of the dextrose is recovered as a syrup having a dextrose equivalent (DE value) in the range of about 60 to about 80. It is usually impractical and uneconomical to attempt to obtain further crystalline dextrose from the mother liquor having such low DE value. The term "dextrose equivalent" as used herein, means the percent of reducing sugar, calculated as dextrose, on a dry basis. Reconversion of the low DE mother liquor is not practical because of the presence of oligosaccharides and destruction products which interfere with the refining of the dextrose product.

It would be desirable to provide a method for treating mother liquor obtained from a dextrose crystallization process so as to increase the dextrose concentration in the mother liquor and to separate the oligosaccharides from the dextrose. It would also be desirable to provide a method for crystallizing dextrose from mother liquor in a shortened period of time. It would further be desirable to provide a method for recovering higher yields of crystalline dextrose from starch converted dextrose solutions.

Accordingly, it is a principal object of the present invention to provide a method for recovering dextrose from mother liquor obtained from a dextrose crystallization process. It is a further object of the present invention to reduce the time required to crystallize dextrose recovered from mother liquor obtained during a dextrose crystallization process. A further object is to improve the process for crystallizing dextrose obtained from mother liquor so as to reduce the capital cost and improve the quality of the product produced therefrom.

These and other objects of the present invention will become more apparent from the following detailed description.

Generally, in accordance with the present invention, the mother liquor obtained from a dextrose crystallization process is treated with an adsorption agent so as to selectively adsorb either the dextrose or the oligosaccharides onto the adsorption agent. As used herein, the term "oligosaccharides" refers to any polysaccharide, which includes disaccharides, trisaccharides and higher sugars. After treatment with the adsorption agent of the invention, the mother liquor is separated into a dextrose-rich portion and an oligosaccharide-rich portion. The dextrose-rich portion is returned to the dextrose crystallizers while the oligosaccharide-rich portion is either reconverted or is used as-is in a syrup form. Useful in the present invention are adsorption agents which preferentially adsorb dextrose and also useful are adsorption agents which preferentially adsorb the oligosaccharides. Preferred adsorption agents are those which preferentially adsorb oligosaccharides because the oligosaccharides are present in the mother liquor in the smaller amount.

The mother liquor from a dextrose crystallization process usually contains about 42 to 51 percent by weight dextrose and 9 to 20 percent by weight oligosaccharides.[1] Adsorption agents which preferentially adsorb dextrose deplete the dextrose concentration in the mother liquor as the mother liquor is passed over the adsorption agent and the adsorption agent must be able to separate dextrose from the mother liquor when the dextrose concentration is low. The concentration of the oligosaccharides increases slightly during the adsorption process when the dextrose is preferentially adsorbed, but remains in the range of from about 10 to about 20 percent. For an adsorption agent wherein the oligosaccharides are preferentially adsorbed, the concentration of dextrose remains relatively unchanged whereas the concentration of the oligosaccharides is reduced. It is generally desirable to provide a feed to the dextrose crystallizer having at least about 90 percent dextrose.

[1]On a total mother liquor weight basis.

Equilibrium data for various adsorption agents in respect to the ability of the adsorption agent to adsorb dextrose and to adsorb oligosaccharides was determined. Maltose was selected as a typical oligosaccharide and the equilibrium data was based upon the adsorption capacity of the adsorption agent for maltose and for dextrose. A known quantity of the adsorption agent was mixed with a known quantity of a solution of pure dextrose or pure maltose of known concentration at 50° C. Refractive index measurements were used to determine the equilibrium concentration for the respective sugar in the liquid and this equilibrium concentration was defined as $C_v$ (grams sugar/100 ml solution). $C_v$ was determined for both dextrose and maltose. The concentration of the respective sugar adsorbed on the adsorption agent was determined by material balance and was defined as $C_R$ (grams sugar/100 ml resin). $C_R$ for both dextrose and maltose was determined. An equilibrium constant for the adsorption agent in respect to dextrose, $K_D$, is defined as $C_v$ (dextrose)/$C_R$ (dextrose). An equilibrium constant for the adsorption agent in respect to maltose, $K_M$, is defined as $C_v$ (maltose)/$C_R$ (maltose).

The ratio of the equilibrium constants, $K_M/K_D$ gives a guantitative indication of the selectivity of the adsorption agent from use in the present invention. As indicated, adsorption agents which preferentially adsorb dextrose decrease the dextrose concentration and such adsorption agents must be able to separate dextrose from oligosaccharides when the dextrose concentration is low and the oligosaccharide concentration is about 10 percent by weight. For this reason, the $K_D$ value at a dextrose concenration of 15 grams/100 ml and the $K_M$ value at a maltose concentration of 10 grams/100 ml were used to specify a significant $K_M/K_D$ value for adsorption agents which preferentially adsorb dextrose. At the indicated concentrations of dextrose and maltose, adsorption agents which preferentially adsorb dextrose preferably have a $K_M/K_D$ value of above at least about 1.5 to be useful in the process of the present invention.

For those adsorption agents which preferentially adsorb the oligosaccharides, the $K_M$ value at a maltose concentration of 5 gms/100 ml and the $K_D$ value at a dextrose concentration of 50 gms/100 ml were used to define a significant equilibrium constant, $K_D/K_M$. To be useful in the process of the present invention those adsorption agents which preferentially adsorb oligosaccharides preferably have a $K_D/K_M$ value at the indicated dextrose and maltose concentrations of at least about 4.0.

Suitable adsorption agents for use in the present invention include strong cation exchange resins in the salt form and granular carbon. Generally, the strong cation ion-exchange resins preferentially adsorb dextrose whereas granular carbon preferentially adsorbs oligosaccharides. The cation exchange resins are preferably based upon copolymers of styrene and ethylvinylbenzene or divinylbenzene. Also suitable are cation exchange resins based on sulfonated phenol-formaldehyde resins, sulfonated copolymers of monovinyl aromatic hydrocarbons and carboxylated resins. Paticularly preferred are cation exchange resins having calcium as the counter ion. Also suitable are cation exchange resins wherein magnesium and aluminum are used as the counter ion.

It should be understood that in the treatment of mother liquor in accordance with the present invention that no ion exchange occurs between the mother liquor and the cation exchange resin. The cation exchange resin is used as an adsorption agent and separation of sugars is accomplished by attractive forces and/or physical entrapment of sugar molecules within the porous structure of the adsorption agent.

In the process of the invention, the mother liquor is transferred through a bed of the adsorption agent. It is preferred that the adsorption agent be loaded in a column through which the mother liquor may be pumped. The diameter of the column and the height of the column are not critical in the practice of the present invention. Of course, larger diameter columns of greater height are capable of holding more of the adsorption agent and operation of the column may be continued for a longer period of time before the adsorption agent becomes saturated with the adsorbed sugar. Generally, a quantity of mother liquor equivalent to from about 0.1 to about 0.5 bed volumes of the adsorption agent may be transferred through the bed of adsorption agent before saturation occurs. In this connection, the term "bed volume" refers to the cubic capacity, including void space, occupied by the adsorption agent within the column. In general, columns more densely packed with adsorption agent are more effective than those wherein the adsorption agent is merely loaded into the column without packing. The flow rate of the mother liquor through the column containing the adsorption agent is preferably maintained at a level of from about 0.1 to about 1.0 gpm/ft$^2$.

After a sufficient level of mother liquor has been transferred over the adsorption agent to saturate the adsorption agent, the flow of mother liquor is stopped. The sugar which is adsorbed onto the adsorption agent is then recovered by elution of the adsorption agent with a suitable solvent for the adsorbed sugar. Generally, from about 0.4 to about 3.0 bed volumes of solvent are required to elute the adsorbed sugar from the column. In this connection, water is a suitable solvent for elution of adsorbed sugar from ion-exchange resins used as adsorption agents. However, it is usually necessary to use a solvent other than water to effect sufficient removal of adsorbed sugar from granular carbon used as an adsorption agent. In this connection, lower molecular weight alcohols have been found to be suitable elution solvents for use in removing adsorbed sugar from granular carbon. By "lower molecular weight alchols", is meant aliphatic mono-hydric alcohols having a carbon chain length of $C_1$ –$C_4$. Particularly preferred alcohols are methanol, ethanol, propanol, isopropanol and butanol.

The concentration of sugars in the mother liquor which is transferred through the adsorption agent is not critical. However, it is preferred to use the concentration normally attained from the first crystallization of dextrose in a dextrose manufacturing process, i.e., about 60 percent solids by weight. Concentrations of sugars in the range of from about 30 percent to about 75 percent are suitable. In this connection it should be understood that the method of the present invention is also suitable for treating the mother liquor obtained after taking a crystal crop from the initial and subsequent mother liquors.

After treatment in accordance with the invention to separate dextrose from oligosaccharides, the dextrose-rich portion is returned to the crystallizers to take another crop of dextrose crystals. It is preferred that the solids level of the dextrose-rich portion be in the range of from about 60 to about 80 percent by weight. The dextrose-rich portion may be concentrated to provide a syrup having the desired level of solids.

The following examples further demonstrate various features of the invention but are not intended to in any way limit the invention which is defined in the appended claims.

EXAMPLE I

The $K_M$ and $K_D$ values for various ion exchange resins were determined. The $K_M$ value was determined at a maltose concentration of 10 percent by weight and the $K_D$ value was determined at a dextrose concentration of 15 percent by weight. The $K_M$, $K_D$ and $K_M/K_D$ values for various resins are reported below in Table I.

Table I

Equilibrium Data For Ion Exchange Resins

| Resin | Counter Ion | $K_{M10}$ | $K_{D15}$ | $K_M/K_D$ |
|---|---|---|---|---|
| XE-200 Rohm and Haas | $Ca^{++}$ | 4.10 | 2.25 | 1.8 |
| XE-100 Rohm and Haas | $Ca^{++}$ | 4.08 | 2.42 | 1.7 |
| C-25 Diamond Alkali | $Ca^{++}$ | 4.33 | 2.55 | 1.7 |
| C-25 Diamond Alkali | $Al^{+++}$ | 5.18 | 3.50 | 1.5 |
| C-25 Diamond Alkali | $Mg^{++}$ | 4.25 | 3.12 | 1.4 |
| C-25 Diamond Alkali | $Fe^{++}$ | 4.72 | 3.38 | 1.4 |
| Dowex 50 Dow Chemical | $Ca^{++}$ | 3.45 | 2.00 | 1.7 |
| DE-23 Whatman | $HSO_3^-$ | 1.48 | 1.00 | 1.5 |
| IRA-400 Rohm and Haas | Oleate | 5.70 | 3.72 | 1.5 |
| IRA-400 Rohm and Haas | $HSO_3^-$ | 2.72 | 3.46 | 0.8 |
| IRA-900 Rohm and Haas | Oleate | 2.50 | 1.76 | 1.4 |
| C-3 Diamond Alkali | $Ca^{++}$ | 2.96 | 2.31 | 1.3 |
| IRA-401 Rohm and Haas | $HSO_3^-$ | 1.77 | 1.34 | 1.3 |
| IRA-4015 Rohm and Haas | $HSO_3^-$ | 2.05 | 1.55 | 1.3 |
| IRA-93 Rohm and Haas | $HSO_3^-$ | 1.76 | 1.40 | 1.3 |
| IR-252 Rohm and Haas | $Ca^{++}$ | 2.32 | 1.94 | 1.2 |
| IR-116 Rohm and Haas | $Ca^{++}$ | 1.47 | 1.22 | 1.2 |
| DE-32 Whatman | $HSO_3^-$ | 1.29 | 1.06 | 1.2 |
| SP-C-25 Sephadex | $Ca^{++}$ | 1.51 | 1.31 | 1.2 |
| CM C-25 Sephadex | $Ca^{++}$ | 1.62 | 1.41 | 1.1 |
| DEAE A-25 Sephadex | $HSO_3^-$ | 1.38 | 1.22 | 1.1 |
| QAE A-25 Sephadex | $HSO_3^-$ | 1.34 | 1.30 | 1.0 |
| CM-32 Whatman | $Ca^{++}$ | 1.16 | 1.15 | 1.0 |

The $K_M$ and $K_D$ values for various granular carbons were determined. The $K_M$ value was determined at a maltose concentration of 5 percent by weight and the $K_D$ value was determined at a dextrose concentration of 50 percent by weight. The $K_M$, $K_D$ and $K_D/K_M$ values for various resins are reported below in Table II.

Table II

Equilibrium Data For Granular Carbons

| Carbon | $K_{M5}$ | $K_{D50}$ | $K_D/K_M$ |
|---|---|---|---|
| Pittsburgh CPG 14 × 40 | 0.20 | 1.44 | 7.2 |
| NUCHAR WV-L 8 × 30 | 0.26 | 1.58 | 6.1 |
| Pittsburgh CAL 12 × 40 | 0.30 | 1.76 | 5.9 |
| NUCHAR WV-G 12 × 40 | 0.22 | 1.27 | 5.8 |
| NUCHAR 503 | 0.30 | 1.62 | 5.4 |
| NUCHAR WV-W 8 × 30 | 0.26 | 1.38 | 5.3 |
| NUCHAR WV-H 12 × 30 | 0.30 | 1.48 | 4.9 |
| WITCO 718 18 × 40 | 0.66 | 1.64 | 2.5 |
| Pittsburgh CPG 14 × 40 (Saturated with octyl alcohol) | 6.0 | 12.2 | 2.0 |

EXAMPLE II

The method of the invention was used to upgrade the dextrose level of mother liquor. Mother liquor from a dextrose crystallization station was used which had 85 percent by weight, of dextrose, dry solids basis. The mother liquor was fed into a 2 inch inside diameter glass column which had been filled with an adsorption agent to various depths. The column was jacketed to provide temperature control. A known quantity of the mother liquor was introduced in the top of the column and was followed by a known quantity of a solvent (usually water) to elute the adsorbed sugar from the adsorbing agent. The results in respect to various operating parameters is reported below in Table III. It is desirable to have at least 90 percent by weight of dextrose, dry basis in the feed to a crystallizer. Consequently only that portion of dextrose recovered from the column which contains 90 percent or higher dextrose is considered significant.

TABLE III

Column Runs With Ion Exchange Resins

| Run No. | Resin | Counter Ion | Feed Percent DS | Feed Percent Dextrose | Feed Bed Volumes | Bed Height Inches | Output (fraction greater than 90 percent Dextrose) gm D/ gm D in feed |
|---|---|---|---|---|---|---|---|
| 54 | XE-200 Rohm and Haas | $Ca^{++}$ | 49.5 | 84.9 | 0.1 | 59 | 0.94 |
| 55 | XE-200 Rohm and Haas | " | 49.5 | 84.9 | 0.1 | 59 | 0.83 |
| 57 | XE-200 Rohm and Haas | " | 50.6 | 84.9 | 0.2 | 59 | 0.56 |
| 37 | C-25 Diamond Shamrock | " | 50.1 | 84.6 | 0.1 | 60 | 0.74 |
| 40 | C-25 Diamond Shamrock | " | 49.8 | 83.3 | 0.2 | 60 | 0.42 |
| 48 | C-25 Diamond Shamrock | " | 51.0 | 84.3 | 0.07 | 60 | 0.50 |
| 44 | C-25 Diamond Shamrock | $Mg^{++}$ | 49.8 | 83.7 | 0.1 | 57 | 0.29 |
| 45 | C-25 Diamond Shamrock | " | 49.8 | 83.7 | 0.1 | 57 | 0 |
| 49 | C-25 Diamond Shamrock | $Al^{+++}$ | 50.1 | 83.3 | 0.1 | 60 | 0.57 |
| 50 | C-25 Diamond Shamrock | " | 49.6 | 82.5 | 0.1 | 60 | 0 |

Column Runs With Fresh Carbon

| Run No. | Carbon | Feed Percent DS | Feed Percent Dextrose | Feed Bed Volumes | Bed Height Inches | Output (fraction greater than 90% Dex.) gm D |
|---|---|---|---|---|---|---|
| 63 | Pittsburgh CPG 14 × 40 | 50.0 | 85.3 | 2.9 | 62 | 1,645 |
| 78 | Pittsburgh CPG 14 × 40 | 50.3 | 86.4 | 2.4 | 118 | 3,297 |
| 41 | NUCHAR WV-G 12 × 40 | 49.8 | 84.6 | 2.8 | 61 | 1,560 |
| 51 | Pittsburgh CAL 12 × 40 | 50.1 | 84.2 | 2.8 | 62 | 1,241 |
| 58 | NUCHAR WV-L 8 × 30 | 50.5 | 85.2 | 3.0 | 65 | 481 |
| 82 | WITCO 718 18 × 40 | 47.8 | 84.6 | 2.0 | 61 | 0 |

What is claimed is:

1. A method for treating a mother liquor from a dextrose crystallization process and recovering a dextrose-rich portion from the treated mother liquor said method comprising:

a. transferring a mother liquor through a bed of an adsorption agent having a $K_M/K_D$ of at least about 1.5 when dextrose is to be preferentially adsorbed by the bed and a $K_D/K_M$ of at least about 4 when oligosaccharides are to be preferentially adsorbed by the bed, b. preferentially adsorbing either the dextrose or the oligosaccharides of the mother liquor in said bed, c. eluting either the adsorbed dextrose or the adsorbed oligosaccharides from said bed with a solvent; and d. recovering a dextrose-rich portion of said mother liquor from the eluted solvent when the dextrose has been preferentially adsorbed by the bed or from the dextrose-rich portion which has passed through the bed when the oligosaccharides are preferentially adsorbed by said bed.

2. A method in accordance with claim 1 wherein a quantity of mother liquor from about 0.1 to about 0.5 bed volumes of said adsorption agent is transferred through said bed of said adsorption agent prior to eluting said adsorption agent with said solvent.

3. A method in accordance with claim 1 wherein said dextrose rich portion of said mother liquor is evaporated to provide a syrup, said syrup is introduced to a crystallizer and dextrose is crystallized from said syrup.

4. A method in accordance with claim 1 wherein said bed preferentially adsorbs oligosaccharides.

5. A method in accordance with claim 4 wherein said adsorption agent is granular charcoal.

6. A method in accordance with claim 5 wherein said solvent is selected from the group consisting of lower molecular weight alcohols and mixtures of lower molecular weight alcohol and water.

7. A method in accordance with claim 1 wherein the bed preferentially adsorbs dextrose.

8. A method in accordance with claim 7 wherein said solvent is water.

9. A method in accordance with claim 7 wherein said adsorption agent is a cation exchange resin.

10. A method in accordance with claim 9 wherein said cation exchange resin is based on a resin selected from the group consisting of copolymers of styrene and ethylvinylbenzene, copolymers of styrene and divinylbenzene, sulfonated phenyl-formaldehyde resins, sulfonated copolymers of monovinyl aromatic hydrocarbons and caboxylated resins.

11. A method in accordance with claim 9 wherein said cation exchange resins have a counter ion selected from the group consisting of calcium, magnesium and aluminum.

12. A method in accordance with claim 11 wherein said counter ion is calcium.

* * * * *

UNITED STATES PATENT AND TRADEMARK OFFICE

CERTIFICATE OF CORRECTION

PATENT NO. : 4,025,357

DATED : May 24, 1977

INVENTOR(S) : Roger S. Leiser; Gin Chain Liaw; Charles E. Schollmeier

It is certified that error appears in the above-identified patent and that said Letters Patent are hereby corrected as shown below:

Column 3, line 25, for "guantitative" read ---quantitative---
Column 3, line 26, for "from" read ---for---
Column 4, line 48, for "alchols" read ---alcohols---

Signed and Sealed this

*Twentieth* Day of *December 1977*

[SEAL]

*Attest:*

RUTH C. MASON
*Attesting Officer*

LUTRELLE F. PARKER
*Acting Commissioner of Patents and Trademark*